US005898643A

United States Patent [19]

Yasuoka et al.

[11] Patent Number: 5,898,643

[45] Date of Patent: Apr. 27, 1999

[54] WATCH WITH RADIO-SIGNAL CORRECTION FUNCTION

[75] Inventors: Tadashi Yasuoka, Saitama; Akinari Takada, Tokyo, both of Japan

[73] Assignee: Citizen Watch Co., Ltd., Tokyo, Japan

[21] Appl. No.: 08/875,846

[22] PCT Filed: Dec. 6, 1996

[86] PCT No.: PCT/JP96/03586

§ 371 Date: Nov. 3, 1997

§ 102(e) Date: Nov. 3, 1997

[87] PCT Pub. No.: WO97/21153

PCT Pub. Date: Jun. 12, 1997

[30] Foreign Application Priority Data

Dec. 6, 1995 [JP] Japan ..... 7-317725

[51] Int. Cl.[6] ..... G04C 11/02

[52] U.S. Cl. ..... 368/47

[58] Field of Search ..... 368/10, 46–49, 368/51, 64, 66; 455/1.1

[56] References Cited

U.S. PATENT DOCUMENTS 4,860,268 8/1989 Allgaier et al. ..... 368/47

5,036,500 7/1991 Ganter ..... 368/47

5,537,101 7/1996 Nakajima et al. ..... 340/825.21

*Primary Examiner*—Vit Miska

*Attorney, Agent, or Firm*—Scully, Scott Murphy and Presser

[57] ABSTRACT

In a watch having a timekeeping function and a function other than timekeeping, this having a radio-signal correction function which can only receive when in the usual timekeeping function, even if the power supply used is a secondary cell, with a limitation on receiving imposed by the mode, after the power supply voltage drops so that the watch stops, even if the power supply voltage is restored, so that receiving is performed automatically, there are modes in which receiving is not done, and the usefulness of the radio-signal correction function is lost.

An automatic receiving condition setting means is provided so that if the power supply voltage or generated amount drops so that the watch stops, after which the power supply or generated amount is restored, reception of a radio signal having a time code is automatically started by the above-noted means.

13 Claims, 11 Drawing Sheets

WATCH WITH RADIO-SIGNAL CORRECTION FUNCTION

FIELD OF THE INVENTION

The present invention relates to a watch which has a radio-signal correction function.

BACKGROUND ART

With advances in quartz watch technology, there has been great improvement in the timekeeping accuracy of watches. However, in striving to attain accurate timekeeping, it is necessary to impart external correction to a quartz watch at some interval.

A type of watch having a radio-signal correction function, a receiving function being added to the watch so as to use a radio or TV time broadcast as a means for correcting the time, has already been adopted for use as facilities watches and in VCRs. In addition, there are longwave standards signals which include time/calendar information in the form of a modulated time code, these being widely used in Europe.

By using this radio signal having a time code, it is not necessary, as it is with a radio-signal correction function watch which uses the information from a radio or TV broadcast, to set the time beforehand, so that even if the time on the watch is incorrect, after radio signal correction is completed, the correct time is accurately captured by the watch.

Thus, a watch having a receiving function which receives a radio signal having a time code not only keeps time accurately, but also does not require the setting of time, making it extremely easy to use.

As watches having a radio-signal correction function gained market acceptance, there has been a desire to have watches with such functions as a local time function, an alarm function, and a chronograph function, which previous multifunction watches had. Because of this desire, the applicant developed a watch with a radio-signal correction function such as set forth in the Japanese Patent Application No. 7-11650.

A previous watch with a radio-signal correction function is described below, with reference being made to relevant drawings.

FIG. 4 is a block diagram of a watch 200 with a radio-signal correction function having a local time function. In this block diagram, the reference numeral 1 denotes an oscillator circuit, which is an oscillation means, 2 is a frequency division circuit which divides the oscillation signal S1 that is output from the oscillator circuit 1, this frequency division circuit thereby generating the frequency-divided signal S2 which is required for the timekeeping of hour/minutes and seconds, and the frequency-divided signal S3 which is required for drive of the minute hand every minute and drive of the second hand every second.

The frequency division circuit 2 has a reset function, and when the reset signal S28 is high, it goes into the reset condition, the minute dividing operation being thereby stopped. The reference numeral 31 denotes a hour/minute drive pulse generating circuit which generates an hour/minute drive pulse S4 from the frequency-divided signal S3 and which, when a non-coincidence signal S5 from an hour/minute position determining circuit is at the high level, continuously outputs the hour/minute drive pulse S4. 32 is an hour/minute counter which performs timekeeping of hours and minutes by counting the frequency-divided signal S2, which can count up by one minute at the rising edge of an hour/minute correction signal S21 from a correction contents selecting means 11 to be described later, and which also corrects the time data in accordance with a time data signal S32 from a time code generating circuit 143.

The hour/minute counter 32 outputs an hour/minute count data signal S6 as time data, and when the time data reaches a priorly established time, this hour/minute counter 32 outputs a scheduled receiving operation signal S23 in high level.

After a certain amount of time has elapsed, or when the time data signal S23 is input, the receiving operation signal S23 is made low level. The reference numeral 33 denotes a time-difference counter, which generates time-difference data using as a reference the time data from the counting data signal S6 of the hour/minute counter 32 and outputs a local time counting data signal S7.

The time-difference data of the time-difference counter 33 is counted up by 1 hour in accordance with the rising edge of a time-difference correction establishing signal S22 from the correction content selecting means 11, which will be described later. The reference numeral 134 denotes an hour/minute hand position determining circuit, which has within it a hand position counter that is linked to the hour/minute hand 36.

When a home time display signal S15 from a switch means 7 to be described later is at the high level, this hour/minute hand position determining circuit 134 makes a coincidence comparison between the hour/minute count data S6 from the hour/minute counter 32 and an internal hand position counter, and if there is non-coincidence between the two, it outputs a non-coincidence signal S5 as a high level.

When the local time display signal S16 from the switch means 7 to be described later is at a high level, the hour/minute hand position determining circuit 134 performs a coincidence comparison between the time-difference count data signal S7 from the time-difference counter 33 and the internal hand position counter, and if there is non-coincidence, it outputs the non-coincidence signal S5 as a high level.

Additionally, when the reference hand position display signal S17 from the switch means 7 is at a high level, the hour/minute hand position determining circuit 134 performs a coincidence comparison between the reference hand position data signal (not shown in the drawing) and the internal hand position counter, and if there is non-coincidence, it outputs the non-coincidence signal S5 as a high level.

The hour/minute drive pulse generating circuit 31, the hour/minute counter 32, the time-difference counter 33, and the hour/minute hand position determining circuit 134 make up the timekeeping means 103. The reference numeral 35 denotes an hour/minute motor which is driven in accordance with the hour/minute drive pulse S4 from the hour/minute drive pulse generating circuit 31, this motor driving the hour/minute hand 36. The hour/minute motor 35 and hour/minute hand 36 make up the display means 4.

The reference numeral 51 is a second drive pulse generating circuit which generates a second pulse drive pulse S11 from the frequency-divided signal S3, and which, when the non-coincidence signal S13 from the second hand position determining circuit is at high level, continuously outputs the second pulse drive pulse S11.

52 is a second counter which performs timekeeping each second by counting the frequency-divided signal S2, and which also clears the time data to zero in accordance with the time data signal S32 from a time code generating circuit 143. The second counter 52 outputs time data as a second count data signal S12.

The reference numeral 153 is a second hand position determining circuit which has an internal second hand position counter (not shown in the drawing) that is linked to the second hand 55.

When the receiving enable signal S42 from the receiving enabling means 12 is at a low level, the second hand position determining circuit 153 performs a coincidence comparison between the second count data S12 from the second counter 52 and the hand position counter, and if there is non-coincidence, it outputs the non-coincidence signal S13 at a high level.

If the receiving enable signal S42 is at a high level, the second hand position determining circuit 153 performs a coincidence comparison between the receiving condition indication position data signal (not shown in the drawing) and the hand position counter, and if there is non-coincidence it outputs the non-coincidence signal S13 at a high level.

Additionally, when the reference hand position display signal S17 from the switch means 7 is at a high level, the second hand position determining circuit 153 performs a coincidence comparison between the second hand reference position data signal (not shown in the drawing) and the hand position counter, and if there is non-coincidence, it outputs the non-coincidence signal S13 at a high level.

The second drive pulse generating circuit 51, the second counter 52, and the second hand position determining circuit 153 make up the timekeeping means 105. The reference numeral 54 denotes a second motor which is driven by a second drive pulse S11 from the second drive pulse generating circuit 51, this motor driving the second hand 55.

The reference numeral 7 is a switch means which is made up of the switches 71*a*, 72*a*, and 73*a*, one of which when in the ON condition is connected to the VDD level (high level), the switches 74*a* and 75*a* which are connected to the VDD level (high level) when in the ON condition, and the pull-down resistors 71*b*, 72*b*, 73*b*, 74*b*, and 75*b* which are connected to the VSS level (low level).

71*a* is a home time display switch (hereinafter referred to as the HT switch) which in the ON condition make the home time display signal S15 a high level (VDD level), and which in the OFF condition makes the home time display signal S15 a low level (VSS level), via the pull-down resistor 71*b*.

72*a* is a local time display switch (hereinafter referred to as the LT switch) which in the ON condition makes the local time display signal S16 a high level (VDD level), and which in the OFF condition makes the local time display signal S16 at a low level (VSS level), via the pull-down resistor 72*b*.

73*a* is a reference hand position display switch (hereinafter referred to as the KT switch) which in the ON condition makes the reference hand position display signal S17 a high level (VDD level) and which in the OFF condition makes the reference hand position display signal S17 a low level (VSS level), via the pull-down resistor 73*b*.

71*a*, 72*a*, and 73*a* form the rotary switch 71. 74*a* is a correction status setting switch (hereinafter referred to as the SJ switch) which in the ON condition makes the correction selection signal S18 a high level (VDD level) and which in the OFF condition makes the correction selection signal S18 a low level (VSS level) via the pull-down resistor 74*b*.

75*a* is a correction switch which in the ON condition makes the correction signal S19 a high level (VDD level) and which in the OFF condition makes the correction signal a low level (VSS level), via the pull-down resistor 75*b*.

The reference numeral 11*a* denotes an AND gate which, when the correction selection signal S18 from the SJ switch 74*a* is a high level, outputs the correction signal S19 from the correction switch 75*a* as the correction signal S20. 11*b* is an AND gate which, when the home time display signal S15 from the HT switch 71*a* is a high level, outputs the correction signal S20 from the AND gate 11*a* as the hour/minute correction signal S21.

11*c* is an AND gate which, when the local time display signal S16 from the LT switch 72*a* is a high level, outputs the correction signal S20 at the time-difference correction signal S22. The AND gates 11*a*, 11*b*, and 11*c* form the correction contents selection means 11.

The reference numeral 12 is an AND gate which is a receiving enable means, and when the home time display signal S15 from the HT switch 71*a* is a high level, this AND gate outputs the scheduled receiving operation signal S23 from the hour/minute counter 32 as the receiving enable signal S42. 41 is an antenna which receives a radio signal having a time code, this generating a radio signal S30.

42 is a receiving circuit which demodulates the radio signal S30, thereby generating the demodulated signal S31. 143 is a time code generating circuit which generates a time code from the demodulated signal S31, and which supplies the time data signal S32 to the hour/minute counter 32 and second counter 52 at the timing of the beginning of a minute. The antenna 41, the receiving circuit 42, and the time code generating circuit 143 form the time code receiving means 113, this time code receiving means operating when the receiving enable signal S42 from the receiving enabling means 12 is a high level.

The operation of a watch 200 with a radio-signal correction function configured as described above will be described with reference to FIG. 4 and FIG. 5. FIG. 5 is an outer view of a watch of the past which had a radio-signal correction function. When the HT switch is in the ON condition, because the home time display signal S15 is at a high level, the hour/minute hand position determining circuit 134 performs a coincidence comparison between the hour/minute count data signal S6 from the hour/minute counter 32 and the internal hand position counter.

For example, if the frequency-divided signal S2, which is a pulse of every second, is counted for 20 seconds and the hour/minute counter 32 advances the hour/minute data by 1, because there is non-coincidence between the hour/minute count data S6 of the hour/minute counter 32 and the hand position counter, the hour/minute hand position determining circuit 134 outputs the non-coincidence signal S5 at a high level.

Therefore, the hour/minute drive pulse generating circuit 31 outputs the hour/minute drive pulse S4. The hour/minute drive pulse S4 drives the hour/minute motor 35 of the display means 4 by one pulse, and the hour/minute hand position determining circuit 134 increments the hand position counter by 1 count, thereby causing coincidence with the hour/minute count data S6, so that the non-coincidence signal S5 is changed to a low level, thereby prohibiting the next hour/minute drive pulse S4 from the hour/minute drive pulse generating circuit 31.

Therefor the hour/minute hand 36 is moved by one step, which is ⅓ of 1 minute, to display the home time. In the same manner, the second hand 55 is moved one step for each second by the second hand position determining circuit 153.

Next, if the user operates the rotary switch 71 which is shown FIG. 4 so that the LT switch 72*a* is placed in the ON condition, because the local time signal S16 changes to a high level, the hour/minute hand position determining circuit 134 performs a coincidence comparison between the time-difference count data S7 from the time-difference counter 33 and the hand position counter.

The time-difference counter 33 generates time-difference data based on the time data of the hour/minute count data S7 from the hour/minute counter 33 and outputs the local time count data signal S7, and the hour/minute hand position determining circuit 134 outputs the non-coincidence signal S5 as a high level until this local time count data signal S7 coincides with the internal hand position counter. Therefore, the hour/minute drive pulse generating circuit 31 outputs the hour/minute drive pulse S4, thus the motor 35 moves the hour/minute hand 36 to display the local time. When this is done, the second display means 6 operates in the same manner as in the case of home time.

If the user operates the rotary switch 71 so that the KT switch 73*a* is in the ON condition, because the reference hand position display signal S17 changes to the high level, the hour/minute hand position determining circuit 134 performs a coincidence comparison between the reference hand position data signal and the hand position counter, and outputs the non-coincidence signal S5 at a high level until these coincide.

Therefore, the hour/minute drive pulse generating circuit 31 outputs the hour/minute drive pulse S4, and the hour/minute motor 35 moves the hour/minute hand 36 so as to display the reference hand position. The second hand position determining circuit 153 operates in the same manner, resulting in the second hand 55 displaying the reference hand position.

The second position counter of the reference hand position is at zero, the hand being moved to the reference hand position. In the reference hand position display condition, in addition to verification of whether or not the hand position is correct, because there is no hand movement done, there is little battery consumption, this being effective when storing for long periods of time.

In a watch 200 of the past, when the time reaches a time to which the hour/minute counter is priorly set (for example, 3 AM), the scheduled receiving operation signal S23 is output at a high level. If the HT switch 71*a* is in the ON condition so that the home time display signal S15 is at a high level, the AND gate 12, which is the receiving enabling means, outputs the scheduled receiving operation signal S23 as the receiving enabling signal S42, thereby placing the time code receiving means 113 in the operating condition.

The time code generating circuit 143 generates a time code from the demodulated signal S31 output from the receiving circuit 42, and when this is completed outputs the time data signal S32 at the timing of the beginning of a minute.

The time data signal S32 corrects the time data of the hour/minute counter 32, and the hour/minute hand 36 of the display means 4 indicates the corrected time data, the second count data of the second hand 52 being cleared to zero, the second hand 55 of the display means 6 being returned to zero. In this manner the watch 200 receives a radio signal with a time code and performs radio signal correction of the time.

When the hour/minute counter 32 reaches 3 AM, the scheduled receiving operation signal S23 is output at high level, and even if in the home time display condition the receiving enabling signal S42 changes to the high level, so that the time code receiving means 113 is place in the operating condition, if the watch 200 with a radio-signal correction function is in a local in which reception of a radio signal having a time code is not possible, it is not possible for the time code generating circuit 43 to output the time-keeping data signal S32, so that when a pre-established amount of time has elapsed (for example 5 minutes), the hour/minute counter 32 returns the scheduled receiving operation signal S23 to the low level, thereby placing the time code receiving means 113 into the non-operating condition, so as to terminate reception.

If at this point rather than the HT switch 71*a*, either the LT switch 72*a* or the KT switch 73*a* is in the ON condition, if the home time display signal S15 is at the low level or the reference hand position display condition is in effect, the AND gate 12, which is the receiving enabling means, outputs the receiving enabling signal S42 at the low level, regardless of the scheduled receiving operation signal S23 from the hour/minute counter 32, thereby prohibiting the operation of the time code receiving means 113. That is, receiving operation is prohibited except when in the home time display condition.

A radio-signal corrected watch 200 of past is used in the home display condition, and when it is possible to receive a radio signal having a time code, keeps extremely accurate time, without the need to set the time. By using the local time display condition, it is possible to use such a watch in areas outside the local time area, such as in an overseas area.

When doing this, the local time is displayed by adding time-difference data to the local time in 1-hour units. With regard to this time-difference data, when the SJ switch 74*a* of the switch means 7 is in the ON condition so that the correction selection signal S18 is at the high level, if the correction switch 75*a* is place in the ON condition the correction signal S19 become high level, and the AND gate 11*a* outputs the correction signal S20 at a high level.

Because the home time display signal S15 is at a low level, the output of the AND gate 11*b* does not change. However, because the local time display signal S16 from the LT switch 72*a* of the AND gate 11c is at the high level, the AND gate 11*c* outputs the correction signal S20 as the time-difference correction signal S22. Therefore, each time the correction switch 75*a* is placed in the ON condition, the time-difference counter 33 counts up by 1 hour on the rising edge of the time-difference correction signal S22. Thus, in the local time display condition, the hour/minute hand 36 is displayed by adding the time difference to the home time.

A radio signal corrected watch 200 such as described above receives a radio signal having a time code and can not only keep time accurately but also does not require the setting of time, making it extremely easy to use.

This radio signal corrected watch 200 performs receiving operation only when the normally used home time display condition is in effect, and in areas in which a radio signal having a time code does not reach an in overseas areas or the area, even in the home time area, to which no radio signal can be reached, can be used in the local time display condition, with operation of the time code receiving means 113, which has a large operating power consumption, being prevented. Even during long periods of storage and when in the reference hand position display condition for verification of the reference hand position, receiving operation is prohibited, so as to conserve consumption current.

In recent years, environmental issues have been given great importance, and there have been advances made in the adoption of such clean energy policies such as eliminating the replacement and disposal of batteries which are used as electrical power generating means in watches as well, so that such clean energy measures are required in radio signal corrected watches as well.

Practical application of clean energy has been made in the form of mechanical electrical generation and solar cells as electrical generating circuits, these being uses as electrical generating means to charge a charged element such as a secondary cell. If it is not charged for a long period of time, a secondary cell exhibits a voltage drop, so that the watch's functions stop.

Therefore, after topping it is necessary to once again perform electrical generation to charge the cell to a voltage that enables operation of the watch's functions. When doing this, although the watch's functions start, the time information before the watch stopped is lost, so that by imparting an electrical power generating means, it is possible by performing receiving operation to correct the time data after the watch is returned to a voltage enabling operation after being stopped.

However, in radio signal corrected watches in the past, which were multifunctional and had a multiplicity of display conditions, the display condition which enables receiving was limited the home time display condition. The present invention has as an object the elimination of the need for the user to set the time after restoration to a voltage that enables operation after the watch was stopped, regardless of the display condition.

DISCLOSURE OF THE INVENTION

A radio signal corrected watch of the present invention for the purpose of solving the above-noted problems has the following basic technical constitution.

Specifically, the watch is a watch with a radio-signal correction function, this watch having a power supply means, an oscillation means, a frequency dividing means which frequency-devides an oscillation signal from the oscillation means, a time signal generating means which generates a time signal based on a frequency-divided signal, a display means which displays the timekeeping contents from the time signal generating means, and a time code receiving means which receives a radio signal that has a time code therein and which sends time data to the time signal generating means, the watch further comprising, a receiving enabled condition discriminating means which discriminates between a condition in which the time code receiving means is in a condition in which reception of the radio signal having a time code is possible and a condition in which the reception is not possible, and an automatic receiving means which, after the receiving enabled condition discriminating means detects the condition in which the time code receiving means is in the condition in that the reception of a radio signal having a time code is not possible, and when the receiving enabled condition discriminating means subsequently detects the condition in which the time code receiving means in in the condition in that the reception of the radio signal having a time code is possible, causes the start of the reception of the radio signal having a time code.

PREFERRED EMBODIMENTS OF THE PRESENT INVENTION

Preferred embodiment of the present invention will be described below, with reference made to relevant drawings.

First Embodiment

Figure 1:
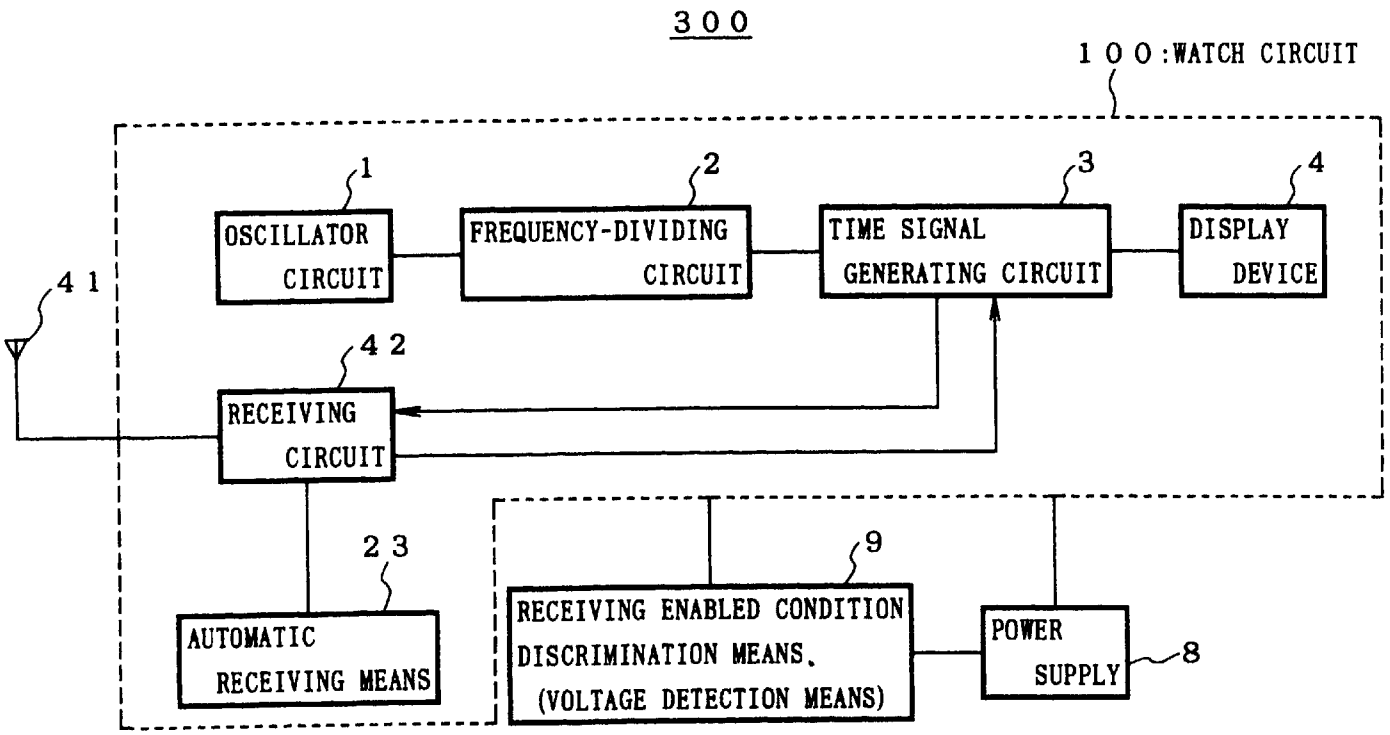
FIG. 1 is a block diagram which shows the configuration of the first embodiment of a radio-signal corrected watch according to the present invention.

FIG. 1 is a block diagram which shows the circuit configuration of the first embodiment of a radio-signal corrected watch 300 according to the present invention. In this drawing, the radio-signal corrected watch 300 has a power supply means 8, an oscillator means 1, a frequency-dividing means 2 which frequency divides an oscillation signal from the above-noted oscillator means 1 and generates a frequency-divided signal, a time signal generating means 3 which generates a time signal based on the above-noted frequency-divided signal, a display means 4 which displays the timekeeping contents from the above-noted time signal generating means 3, and a time code receiving means 42 which receives a radio signal having a time code and which sends time-keeping data to the above-noted time signal generating means 3.

This radio-signal corrected watch 300 further has a receiving enabled discriminating means 9 which discriminates whether or not the above-noted time code receiving means 42 can receive a radio signal having a time code, and an automatic receiving means 23 which, after the above-noted receiving enabled condition discriminating means 9 detects the condition in which reception of a radio signal having a time code is not possible, when the receiving enabled condition discriminating means 9 then detects the condition in which reception of a radio signal having a time code is possible by the time code receiving means 42, causes the start of the reception of the radio signal having a time code.

This configuration will be described below, for the case in which the receiving enabled condition discriminating means 9 is, for example, a voltage detection means.

Specifically, in FIG. 1, the oscillator circuit 1 generates a reference signal, and the frequency-dividing means 2 frequency divides this reference signal.

The time signal generating means 3, which has a function similar to the timekeeping means, generates a time signal based on the frequency-divided signal, and periodically (for example, one time daily) outputs a receiving command signal to a receiving circuit 42 which will described later, the display device 4 displaying the time based on the above-noted time signal.

The receiving circuit 42 receives the standard radio signal, generates a time signal based thereon, and outputs this to the time signal generating circuit 3, which is a timekeeping means. The receiving circuit 42 does not operate at all times, rather operating based on a receiving command signal which is output from the above-described time signal generating circuit 3 or a receiving command signal output from the automatic receiving means 23 which will be described later. 41 is an antenna.

In the present invention, the an oscillator means 1, frequency-dividing means 2, time signal generating circuit 3, display device 4, receiving circuit 42, and automatic receiving means 23 form the watch 100.

The voltage detection means 9 detects the voltage of the power supply means 8, and if this exceeds a prescribed value outputs a high-level detection signal, and outputs a low-level detection signal if it is below the above-noted prescribed value.

When the detection signal of the automatic receiving means 23 is switched form the low level to the high level, it automatically outputs a receiving command signal, placing the receiving circuit 42 in the operating condition.

The power supply 8 is the power supply of the radio-signal corrected watch 300 according to the present invention, and it is desirable that this be a power supply having an electricity generating function.

While it is not shown in the drawing, the radio-signal corrected watch 300 can be provided with an external switch means, so that time correction o the time signal generating circuit 3 is possible by the user, and it is further possible that the receiving circuit 42 operation be performed in a forced manner.

Next, the specific operation of this embodiment shown in FIG. 1 will be described.

In the case in which the voltage of the power supply 8 exceeds a prescribed value, the time signal generating circuit 3 generates a time signal, based on the signal from the oscillator circuit 1 via the frequency-dividing circuit 2, and the display device 4 displays the current time. When a preestablish time is reached, the time signal generating circuit 3 outputs a receiving command signal to the receiving circuit 42, which results in the start of reception by the receiving circuit 42.

When the receiving circuit 42 captures time-keeping data, it output the time-keeping data to the time signal generating circuit 3. As a result, the time signal generating circuit 3 is corrected to the correct time.

If, however, the voltage of the power supply 8 is below the prescribed value, the voltage detection means 9 outputs a detection signal at the low level. This signal is received, and the watch circuit 100 which includes the frequency-dividing circuit 2 and the time signal generating circuit 3, which is the timekeeping means, goes into the stopped condition.

In this condition, because the time signal generating circuit 3, which is the timekeeping means, is also stopped, the watch itself is in the stopped condition.

When the voltage of the power supply 8 rises so as to exceed the prescribed voltage, the voltage detection means 9 outputs a high-level detection signal. This starts the operation of the watch circuit 100, and the automatic receiving means 23 outputs a receiving command signal to the receiving circuit 42. Therefore, the receiving circuit 42 starts to receive, and outputs timekeeping to the time signal generating circuit 3, which results in the radio-signal corrected watch 300 displaying the correct time.

In a second embodiment of the present invention such as described above, even if the power supply voltage falls, so that the watch stops temporarily, because reception is performed automatically when the power supply voltage is restored, it is possible to eliminate the correction operation made by the user. This is particularly effective in cases in which there is a possibility that the voltage will change frequently, such as is the case with a power supply having an electricity generating function.

Second Embodiment

Figure 6:
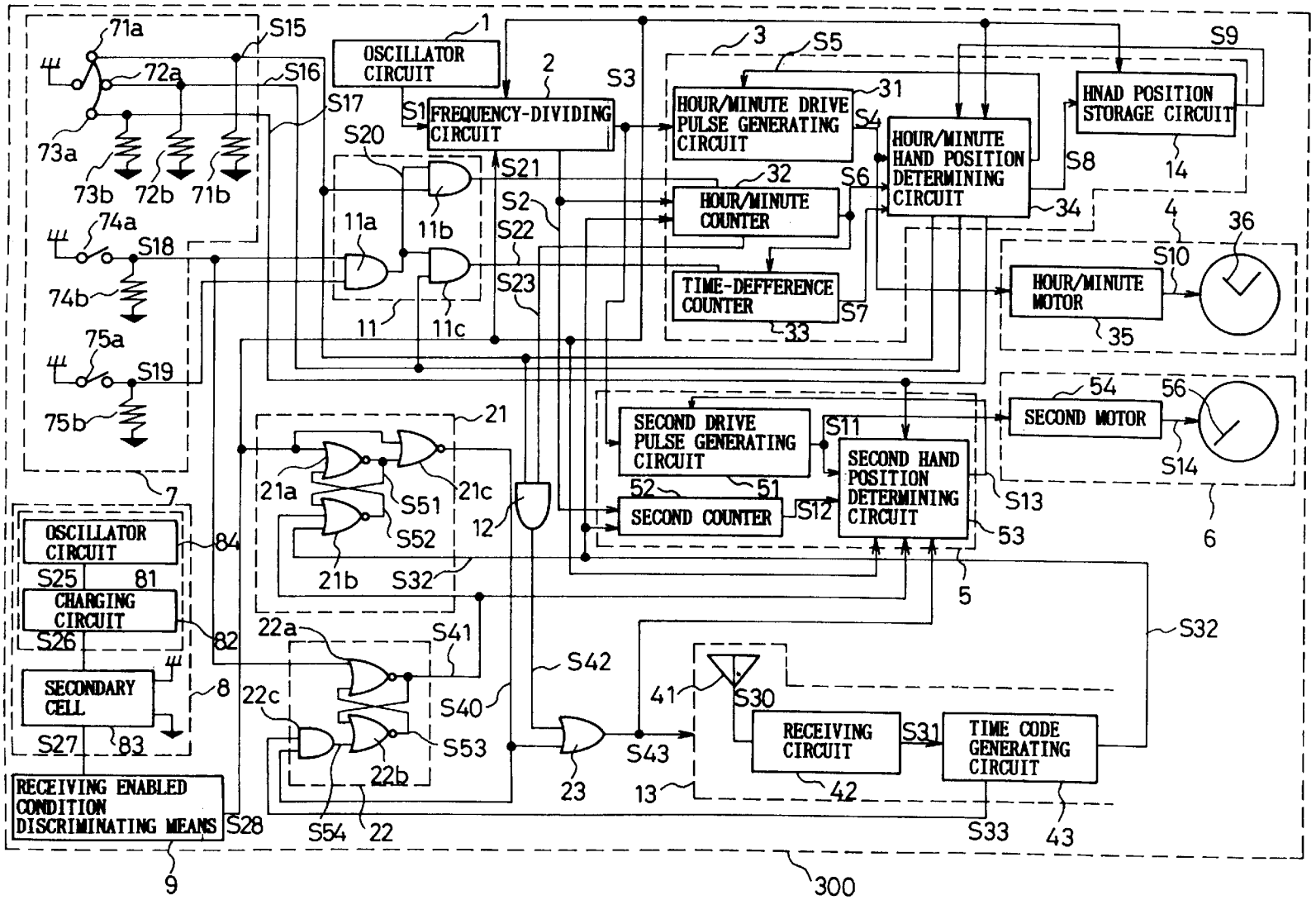
FIG. 6 is a block diagram which shows the configuration of the second embodiment of a radio-signal corrected watch according to the present invention.

Next, a more detailed circuit configuration of a radio-signal corrected watch 300 according to the present invention will be presented, with reference being made to FIG. 6.

Specifically, FIG. 6 is a block diagram which illustrates in more detail the configuration of a radio-signal corrected watch 300 according to the present invention. The watch shown in this drawing is a radio-signal corrected watch 300 which has a power supply means 8, an oscillator means 1, a frequency-dividing means 2 which frequency divides an oscillation signal from the above-noted oscillator means 1 and generates a frequency-divided signal, a time signal generating means 3 which generates a time signal based on the above-noted frequency-divided signal, display means 4 and 6 which display the timekeeping contents from the above-noted time signal generating means 3, and a time code receiving means 13 which receives a radio signal having a time code and which sends time-keeping data to the above-noted time signal generating means 3.

This radio-signal corrected watch 300 further has a receiving enabled discriminating means 9 which discriminates whether or not the above-noted time code receiving means 13 can receive a radio signal having a time code, and a reception starting means 12 which, after the above-noted receiving enabled condition discriminating means 9 detects the condition in which reception of a radio signal having a time code by the time code receiving means 13 is not possible and when the receiving enabled condition discriminating means 9 then detects the condition in which reception of a radio signal having a time code by the time code receiving means 13 is possible causes the start of the reception of the radio signal having a time code.

It is possible for the receiving enabled discriminating means 9 used in the above-noted radio-signal corrected watch 300 according to the present invention to be such that it makes a judgment of one selected characteristic value from such values as the voltage or electrical generating capacity of the power supply 8, and it is also possible for it to have a function which performs a judgment as to whether or not the radio signal having a time code can itself be received, because of its weakness.

The radio-signal corrected watch 300 according to the present invention can be a mutlifunction radio-signal corrected watch having a display contents selection means which minimally displays the display contents, this display contents selection means being operable by a switch means so as to change the display contents, and an alarm function or chronograph function.

Additionally, the power supply means 8 which is used in the radio-signal corrected watch 300 according to the present invention can be formed by an electricity generating means 81 and a charging means, that is, a storage battery 83, this charging means generally being what is known as a secondary cell, which has characteristics that exhibit both a rise and a fall in output voltage.

The electricity generating means 81 which is used in the radio-signal corrected watch 300 according to the present invention can be, for example, a mechanical electricity generating means or a solar cell.

The operation of the circuit configuration and operation thereof will be explained with reference being made to FIG. 6, for the case in which the receiving enabled discriminating means 9 has a mechanism for detecting the output voltage of the power supply means 8, and making the judgment about whether or not reception of the radio signal having a time code is possible.

Figure 4:
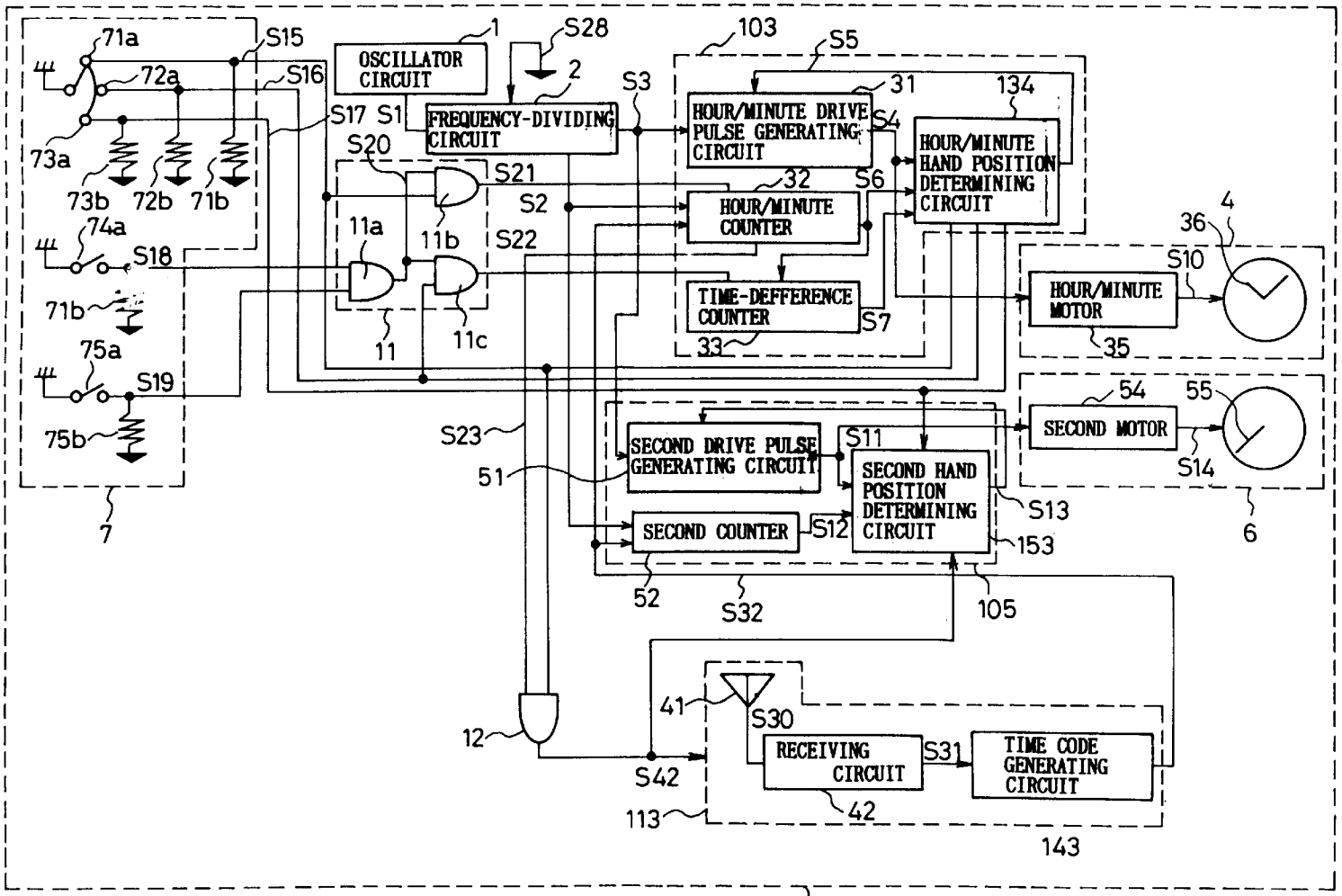
FIG. 4 is a block diagram of an example of the configuration of a radio-signal corrected watch of the past.
Figure 5:
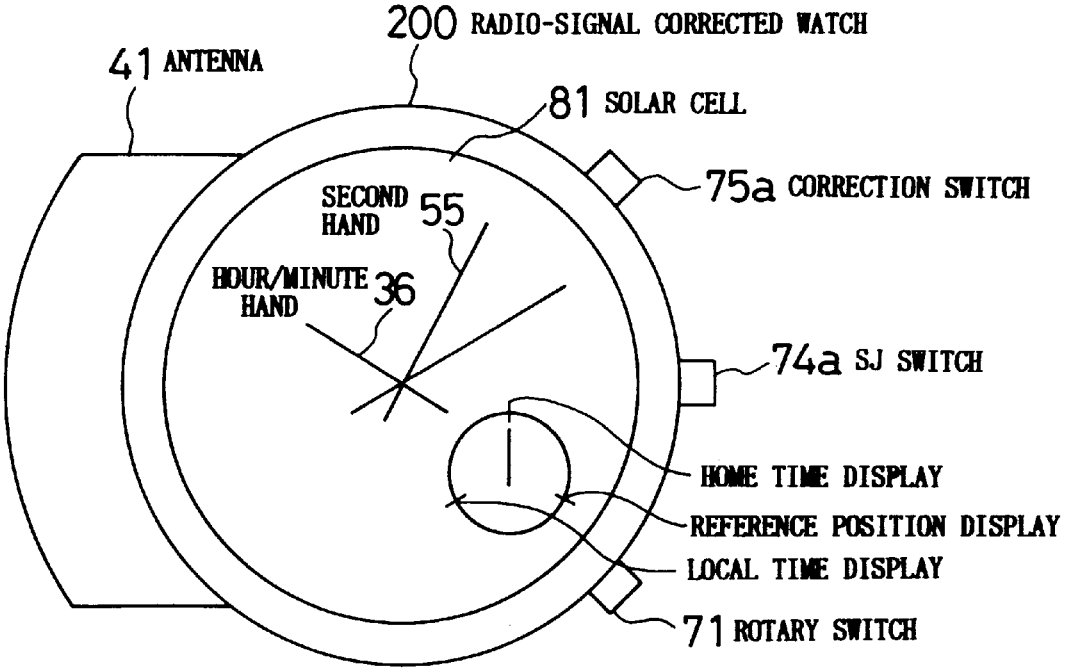
FIG. 5 is an outer view of a radio-signal corrected watch of the past.

In FIG. 6, elements corresponding to elements in FIG. 4 have been assigned the same reference numerals, and will omitted from this description. The reference numeral 81 denotes an electricity generating circuit which, in the embodiment of the present invention is an electricity generating means that is a solar cell or a mechanical type electrical generator, this generating a generation signal S25 which is supplied to the charging circuit 82. The charging circuit 82 charges the secondary cell 83 with the charging signal S26, and also not prevents only reverse flow of the charging signal S26 from the secondary cell 83 but also prevents overcharging of the secondary cell 83.

The electricity generating circuit 81, the charging circuit 82, and the secondary cell 83 form the electrical power generating means 8. The reference numeral 9 denotes a voltage detection circuit, which is a voltage detection means, which monitors the voltage drop from the power supply signal S27 output from the secondary cell, and which outputs a voltage detection signal S28 at a high level when this voltage drops to the voltage at which the watch is stopped.

The reference numeral 14 denotes a hand position storage circuit which is a non-volatile memory that, when the voltage detection signal S28 from the voltage detection circuit 9 rising from a low level to a high level, inputs and stores the storage signal S8, which is information output from the hour/minute hand position determining circuit 34, so that this is not lost even if the power supply voltage becomes zero. When the voltage detection signal S28 changes from high level to low level, the hand position storage circuit 14 sends the stored data to the hour/minute hand position determining circuit 34 as the storage signal S9.

The reference numeral 34 denotes an hour/minute hand position determining circuit which is a circuit which the hour/minute hand position determining circuit 134 of the radio-signal corrected watch 200 of the past with the addition of the input of the output storage signal S8 hour/minute hand position information and the storage signal S9 from the hand position storage circuit 14, this circuit sending the hour/minute hand position information as the storage signal S8 when the voltage detection signal S28 rises from low level to high level.

When the voltage detection signal S28 falls from high level to low level, the storage data of the hand position storage circuit 14 is input as the storage signal S9, this being used as the hour/minute hand position information at that timing.

The hour/minute drive pulse generating circuit 31, the hour/minute counter 32, the time-difference counter 33, the hour/minute hand position determining circuit 34, and the hand position storage circuit 14 form the watch means 3. If the time code generating circuit 43 in this embodiment of the present invention could not receive, it is configured so as to output an unreceivable signal S33.

The reference numeral 53 denotes a second hand position determining circuit which is the second hand position determining circuit 153 of the radio-signal corrected watch 200 of the past with the addition of an internal TW counter (not shown in the drawing) that corresponds to an indication position of a stopping alarm condition, and an SW counter (not shown in the drawing) that corresponds to a correction alarm condition position.

There is also input thereto of the voltage detection signal S28 and a correction alarm signal S41, when the voltage detection signal S28 is at the high level, the hand position counter and the TW counter being made to coincide, and when the correction alarm signal S41 is high, the hand position counter and SW counter are caused to coincide, thereby causing the second hand-to stop at various stopping positions.

The second drive pulse generating circuit 51, the second counter 52, and the second hand position determining circuit 53 form the watch means 5. The reference numeral 43 denotes a time code generating circuit, which is the time code generating circuit 143 of the radio-signal corrected watch 200 of the past with that addition of a function that outputs an unreceivable signal S33 when it was not possible to generate a time code. The antenna 41, the receiving circuit 42, and the time code generating circuit 43 form the time code receiving means 13.

The reference numeral 21 denotes an automatic receiving condition setting means, which is formed by the NOR gates 21*a*, 21*b*, and 21*c*, which are configured so that when the power supply voltage drops, causing the voltage detection signal S28 to change to the high level, this information is held, and when the signal return to the low level the automatic receiving signal S40 is outputs at a high level.

The reference numeral 22 is a correction alarm condition setting means, this being formed by the NOR gates 22*a* and 22*b* and the AND gate 22*c*, so that after the automatic receiving signal S40 is detected, receiving becomes impossible, and when the time code generating means 43 outputs the unreceivable signal S33, the correction alarm signal S41 is output at a high level. The reference numeral 23 is an OR gate which forms an automatic receiving enabling means by, for example, an automatic receiving condition setting means 21 and a receiving enabling means 12.

Therefore, if the receiving enabling signal S42 form the receiving enabling means 12 or the automatic receiving signal S40 from the automatic receiving condition setting means 21 is high level, the OR gate 23 that forms the above-noted automatic receiving enabling means outputs the receiving enabling signal S43 at a high level.

Figure 2:
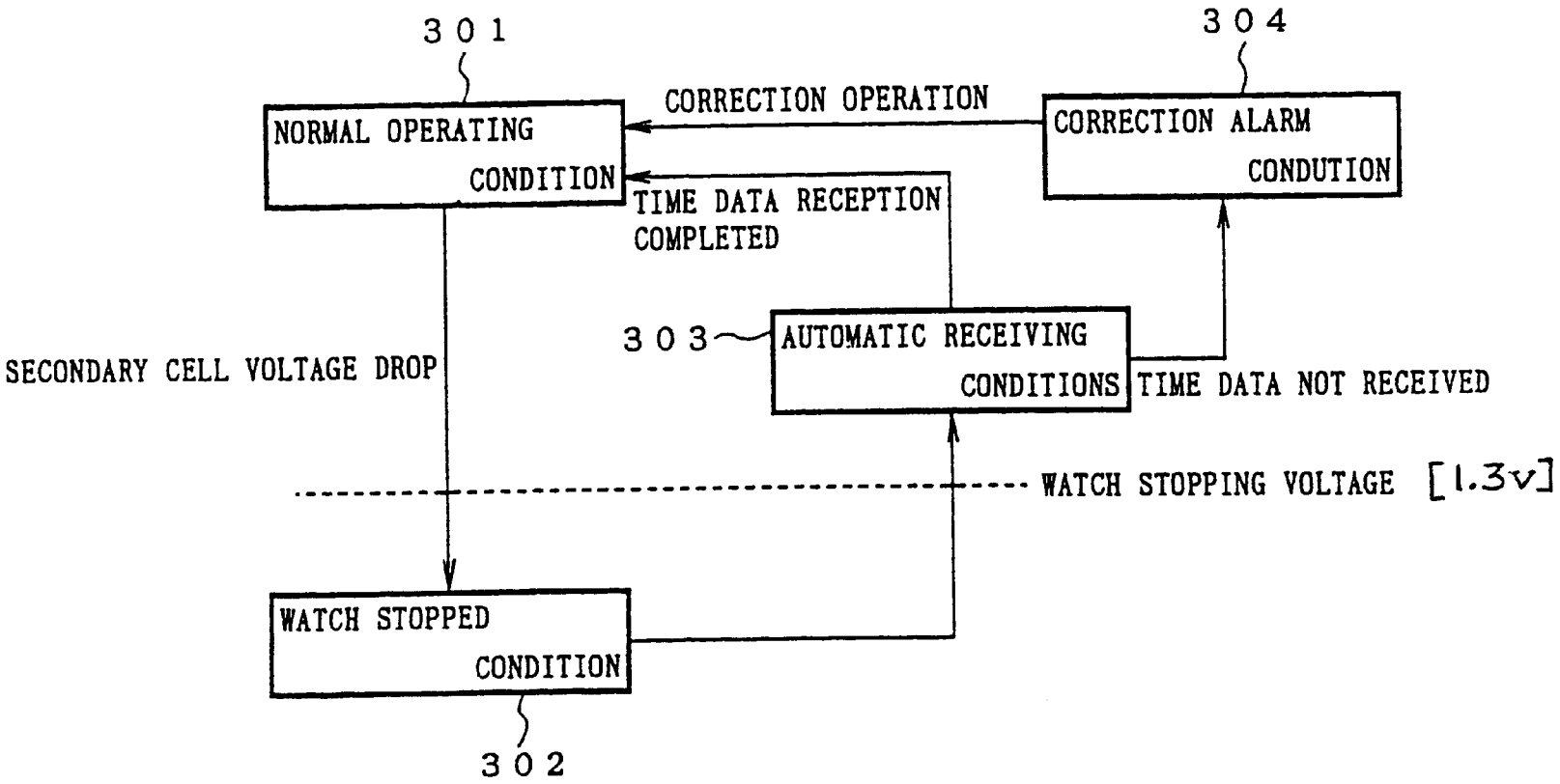
FIG. 2 is a block diagram which shows the state transitions in a radio-signal corrected watch according to the present invention.
Figure 3:
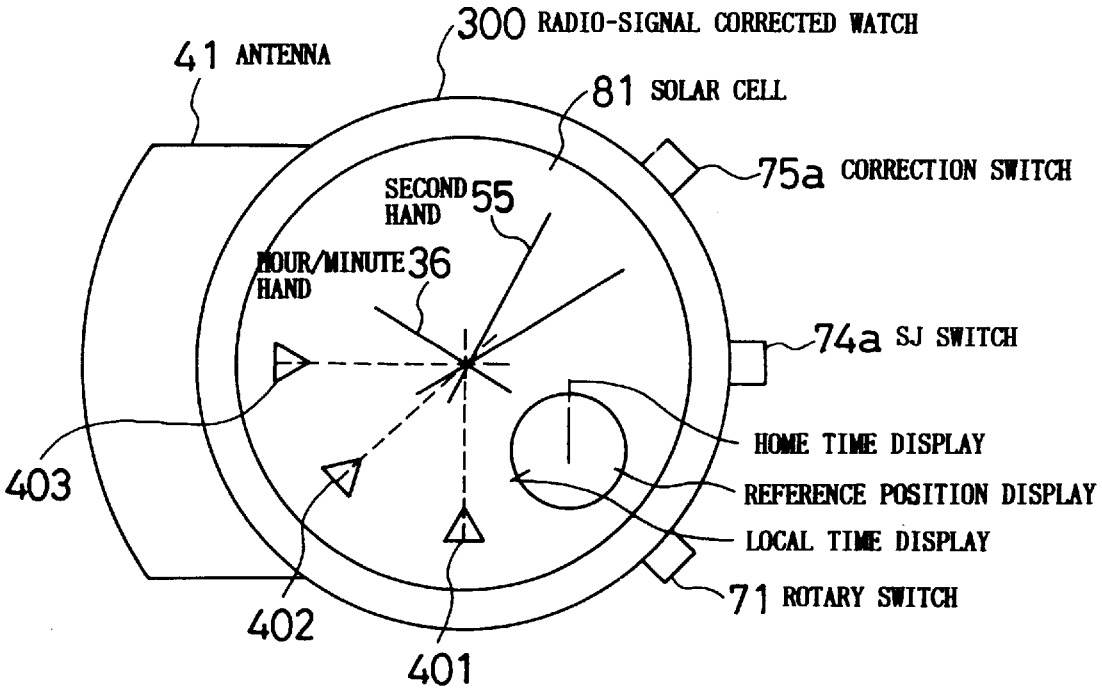
FIG. 3 is an outer view of a radio-signal corrected watch according to the present invention.

The operation of the radio-signal corrected watch 300 according to the present invention which is configured as described above will be described with reference being made to FIG. 2 and FIG. 3. FIG. 2 is a state transition diagram of the radio-signal corrected watch 300 according to the present invention, and FIG. 3 is an outer view of the radio-signal corrected watch 300 according to the present invention.

In the normal operating state show in FIG. 2, light is striking the solar cell 81 and the secondary cell 83 is being charged by the charging circuit 82, the voltage detection circuit 9 detecting that the power supply signal S27 from the secondary cell 83 is above the watch stopping voltage of 1.3

V, thereby outputting the voltage detection signal S28 at the low level. Therefore, the frequency-dividing circuit 2 operates to divide frequency, and operation is the same as in the radio-signal corrected watch 200 of the past.

If a condition continues in which light does not strike the solar cell 81, the generation signal S25 is not generated, and it is not possible for the charging circuit 82 to supply the charging signal S26 to the secondary cell 83. Therefore, because the condition in which the secondary cell 83 is not being charged continues, the charging voltage is reduced. When the voltage detection circuit 9 detects that the power supply signal is below the watch stopping voltage of 1.3 V, the voltage detection signal S28 changes from low level to high level, which changes the state to the watch stopped condition 302 shown in FIG. 2.

In the watch stopped condition, by the voltage detection signal S28 changing from low level to high level, not only does the frequency-dividing circuit 2 stop, but also the hour/minute hand position determining circuit 34 sends the hour/minute hand position information as the storage signal S8 to the hand position storage circuit 14, thereby storing the timekeeping information of the storage signal S8 in the hand position storage circuit 14.

Even if any of the HT switch 71*a*, the LT switch 72*a*, and the KT switch 73*a* is set to on, the hour/minute hand position information is stored in the hand position storage circuit 14. Also, because the voltage detection signal S28 is at the high level, the output of the NOR gate 21*a* which makes up the automatic receiving condition setting means 21, is at the low level.

At this time, with the automatic receiving signal S40, which is the output of the NOR gate 21*c*, at the low level, since the correction alarm signal S41 and the time-keeping data signal S32 are both low level, the signal S51 is held at the low level. Additionally, since the voltage detection signal S28 is at the high level, the second hand position determining circuit 53 causes the second hand 55 of the display means 6 to indicate the stopping alarm condition hand position 402 of FIG. 3.

Next, when light strikes the solar cell 81, the generation signal S25 is generated, an the charging circuit 82 outputs the charging signal S26 to the secondary cell 83. Therefore, the secondary cell 83 is charged, thereby increasing the charging voltage. Thus, when the voltage detection circuit 9 detects that the power supply signal S27 is above the watch stopping voltage 1.3 V, the voltage detection signal S28 changes from high level to low level, and the state changes to the automatic receiving state which is shown in FIG. 2.

In the automatic receiving state, by the voltage detection signal S28 changing from high level to low level, the frequency-dividing circuit 2 starts to operate, and the hour/minute hand position determining circuit 34 inputs the hour/minute hand position information as the storage data of the hand position storage circuit 14, this being used and displayed as the hour/minute hand position information at that time.

Since the voltage detection signal S28 is at the low level, because the signal S51 of the automatic receiving condition setting means 21 is at the low level, the automatic receiving signal S40 output of the NOR gate 21*c* changes to high level, so that the OR which is the automatic receiving enabling means sets the receiving enabling signal S43 to the high level. Therefore, even if any of the HT switch 71*a*, the LT switch 72*a*, and the KT switch 73*a* is set to on, the time code receiving means 13 is in the operating condition, and reception is started. The time code generating circuit 43 generates a time code from the demodulated signal S31 output of the receiving circuit 42, and when this is completed, generates time-keeping data signal S32 at the timing of the beginning of a minute.

The time-keeping data signal S32 corrects the hour/minute counter 32 time-keeping data, and the hour/minute hand 36 of the display means 4 indicates the time-keeping data after correction, the second counter 52 second count data being cleared to zero. At this time, the high-level time-keeping data signal S32 is input to the NOR gate 21*b*, which makes the automatic receiving signal S40 output by the OR gate 23 that forms the automatic receiving condition setting means 21 low level.

The result is that the time code receiving means 13 ends the operating condition. Because the voltage detection signal S28, the correction alarm signal S41, and the receiving enable signal S43 are low level, the second hand position determining circuit 53 causes the corrected contents of the second counter by means of the second hand 55, via the internal second hand counter.

In the automatic receiving condition, even if the time code receiving means 13 goes into the operating condition, and time code is generated from the demodulated signal S31 output by the receiving circuit 42, if this cannot be judged to be the correct time within a prescribed amount of time, the unreceivable signal S33 is output at the high level.

When this is done, because the automatic receiving signal S40 is at the high level, the signal S54 which is input to the NOR gate 22*b* via the AND gate 22*c* of the correction alarm condition setting means 22 become high level, and because the correction selection signal S18 is low level, the correction alarm signal S41 changes to high level, the state becoming the correction alarm condition which is shown FIG. 1.

Because the correction alarm signal S41 is at the high level, the second hand position determining circuit 53 causes the SW counter contents to be displayed by the second hand 55 of the display means 6. That is, the second hand 55 indicates the correction alarm condition position 403 which is shown FIG. 3. In the case described above in which the time correction by automatic receiving was not possible, because the correction alarm condition occurs, the SJ switch 74*a* is set to the ON condition, and hour/minute correction is performed by operating the correction switch 75*a*.

At this time, if the SJ switch 74*a* is placed into the ON condition, the correction selection signal S18 changes to high level, and the correction alarm signal S41, which is the output of the NOR gate 22*a* of the correction alarm condition setting means 22, changes to the low level, the state changing to the normal operating condition.

In a radio-signal corrected watch 300 of the embodiment of the present invention, although a solar cell 81 and charging circuit 82 are provided, the secondary cell 83 being charged for operation by light energy, if light energy is not imparted, the secondary cell 83 will not be charged, an the voltage of the secondary cell is drop. When the voltage detection circuit 9 detects at drop to below the watch stopping voltage, by means of the voltage detection signal S28, the hour/minute hand position is stored in the hand position storage circuit, the second hand 55 indicates the stopped alarm, and the frequency-dividing circuit 2 is stopped, the user being thus urged to perform charging using light energy.

At this point, if charging by light energy is done by the user so that the secondary cell is charged, when the voltage detection circuit detects that the voltage exceeds the watch stopping voltage, the voltage detection signal S28 starts the operation of the frequency-dividing circuit 2, the hand position storage circuit 14 sends stored hour/minute hand position data to the hour/minute hand position determining circuit 34, so that even if reference hand position correction is not performed, the hour/minute hand position coincides with the hour/minute counter 32, the time-difference counter 33, or the reference hand position.

If at this time the voltage detection signal S28 causes the automatic receiving condition setting means 21 to go into the automatic receiving condition, the time code receiving means will start operation via the automatic receiving enabling means 23. When the generation of the time code is performed normally, the time code generating means 43 sends the time-keeping data as the time data signal S32 to the hour/minute counter 32 and to the second counter 52 to perform time correction.

Therefore, even if the voltage of the secondary cell 83 drops to below the watch stopping voltage, so that the time data is lost, if the voltage of the secondary cell 83 is restored to greater than the watch stopping voltage, receiving is performed automatically, a time code is generated and radio-signal correction is performed and, because the hand position information is held even while the watch is stopped, it is unnecessary for the user to perform a correction operation. In the automatic receiving condition, if the time code receiving means 13 does not generate a time code normally, the unreceivable signal S33 is output, the correction alarm condition setting means 22 going into the correction alarm condition, and the second hand 55 being caused, via the second hand position determining circuit 53, to move to the alarm correction condition indicating position.

Therefore, recognizing the correction alarm condition, the user performs a correction operation using the switch means 7. The automatic receiving condition will always be performed, regardless of whether the switch means 7 selects the home time display, the local time display, or the reference hand position display, and even after the automatic receiving condition is completed, the home time display, local time display, or reference hand positions display, as selected by the switch means 7, is made.

An example of a radio-signal corrected watch 300 according to the present invention as described above can be summarized as follows. Specifically, it is a radio-signal corrected watch having a oscillator means 1, a frequency-dividing means 2 which frequency divides an oscillation signal from the above-noted oscillator means 1 and generates a frequency-divided signal, a time signal generating means 3 which generates a time signal based on the above-noted frequency-divided signal, time signal generating means 3 and 5 (hereinafter referred to as simply watch circuits) which keep time based on the above-noted frequency-divided signal, display means 4 and 6 which display the timekeeping contents from the above-noted time signal generating means 3, a display content selecting means 7 which selects the display contents to be displayed by display means 4 and 6, switch means 71 through 75 which operate the above-noted display content selecting means 7, a time code receiving means 13 which receives a radio signal having a time code and which sends time-keeping data to the above-noted watch means 3, and a receiving enabling means 12 which enables reception, depending upon the display contents which are selected by the above-noted display contents selecting means 7.

This watch further has a power supply means 8 which is formed by a storage battery which is connected to a electrical generating means 81 and a charging circuit 82, a voltage detection means 9 which monitors the voltage of the power supply means 8, and an automatic receiving condition setting means 21 which after the voltage detection means 9 detects the drop of voltage of the power supply means 8 to the watch stopping voltage, when it detects that the voltage once again is restored to an operating voltage, sets the automatic receiving condition until a reception complete signal is received from the above-noted time code receiving means 13, and in this watch further has an automatic receiving enabling means 23 which, in the period during which the automatic receiving condition setting means 21 sets the automatic receiving condition, regardless of the display contents selected by the above-noted display contents selecting means 7, sets the above-noted time code receiving means 13 to the automatic receiving condition.

Additionally, according to the above-described embodiment, even if the above-noted automatic receiving means 21 goes into the automatic receiving condition, so that the above-noted time code receiving means 13 goes into the receiving condition, there is a correction alarm condition setting means 22 provided which, in the case in which it is not possible to receive a time code, until the above-noted switch means is used to perform correction of the above-noted watch means, maintains the correction alarm condition.

Third Embodiment

Figure 7:
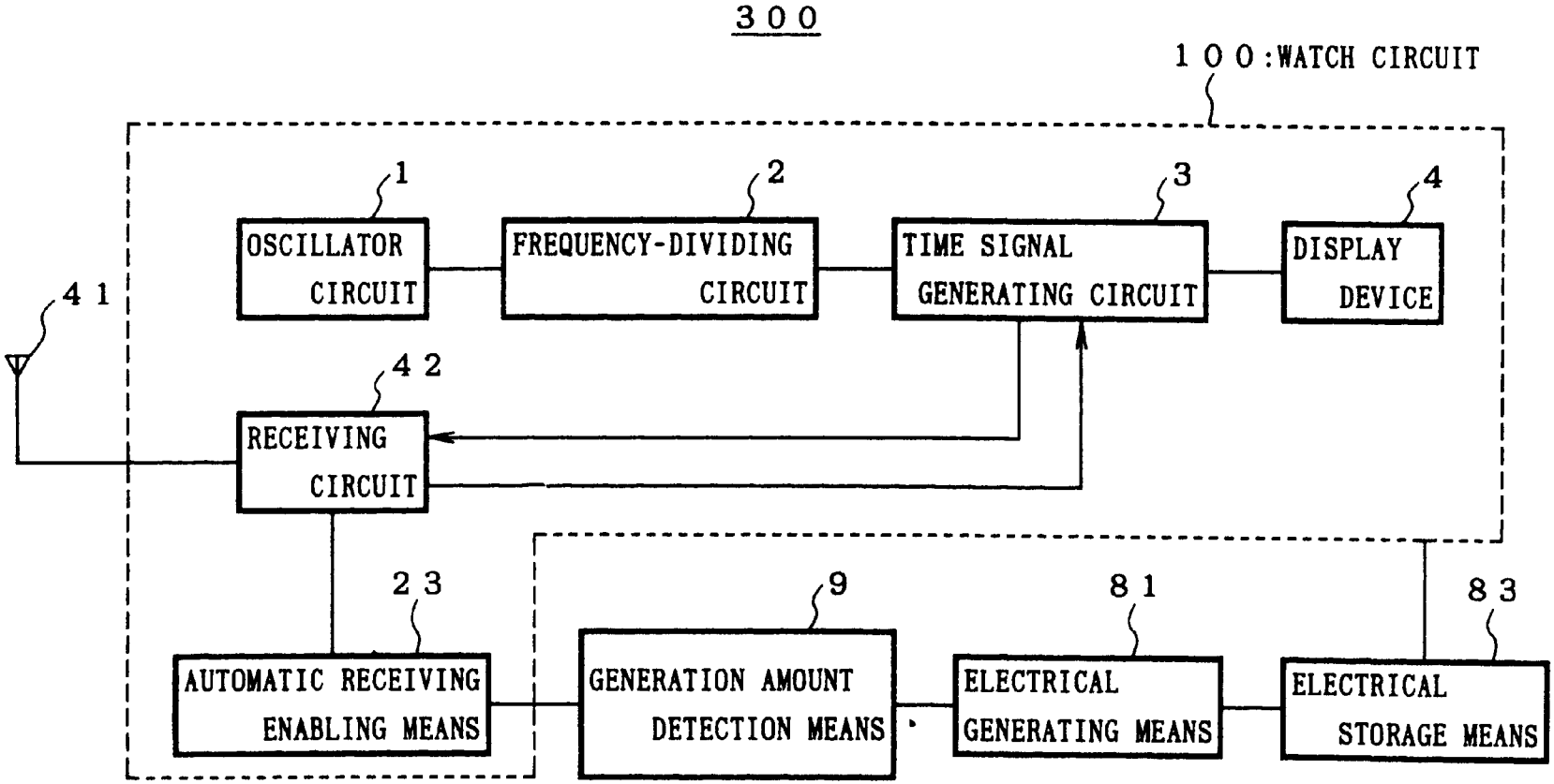
FIG. 7 is a block diagram which shows the configuration of the third embodiment of a radio-signal corrected watch according to the present invention.

FIG. 7 shows a third embodiment of a radio-signal corrected watch according to the present invention, for the case in which the receiving enabled condition discriminating means 9 is a generation capacity detection means which detects amount of electrical generation of the electricity generating circuit.

In FIG. 7, elements corresponding to elements in FIG. 1 have been assigned the same reference numerals, and will omitted from this description.

The generating capacity detection means 9 detect the amount of electrical generation of the electrical generating means 81, and outputs an electrical generation detection signal when the generation amount exceeds a prescribed value. The electrical generating means 81 is a means of converting light energy or kinetic energy to electrical energy, and the electrical storage means 83 is a means for storing electrical energy.

Next, the specific operation of this embodiment will be described. The normal operating condition is the same as explained with regard to the first embodiment, and will thus not be described here.

When the watch is normally operating, accompanying a drop in voltage, the watch circuit 100 stops. If the electrical generating means 81 starts to generate electricity and exceeds the prescribed value, the generating capacity detection means 9 outputs a electrical generation detection signal. Upon receiving this signal, the watch circuit 100 starts to operate. Then, the automatic receiving enabling means 23 outputs a receiving command signal to the receiving circuit 42.

The receiving circuit 42 receives this signal and begins receiving operation, capturing time data and outputting it to the time signal generating circuit 3. Therefore, the time displayed is the correct time.

It is possible to embody the present invention without using a voltage detection means as described above.

In present invention as described above, because of the provision of a receiving enabled condition discriminating means 9 which detects whether or not receiving is possible, and the provision of an automatic receiving enabling means 23 which outputs a receiving command signal to the receiving circuit 42 by means of the output signal from the above-noted receiving enabled condition discriminating means 9, even if a condition occurs in which reception is not possible, causing the watch circuit timekeeping to be disturbed, when it becomes possible to receiving, reception is immediately performed, and timekeeping correction is made, so that there is no need for the user to go to the trouble of performing a receiving operation.

Fourth Embodiment

Next, the fourth embodiment will be described, with reference being made to FIG. 8.

In the fourth embodiment, the configuration is such that when the receiving circuit 42 of FIG. 1 succeeds in making reception, a reception succeeded signal is output. The specific operation will now be described, with reference being made to the flowchart which is shown in FIG. 8.

Figure 8:
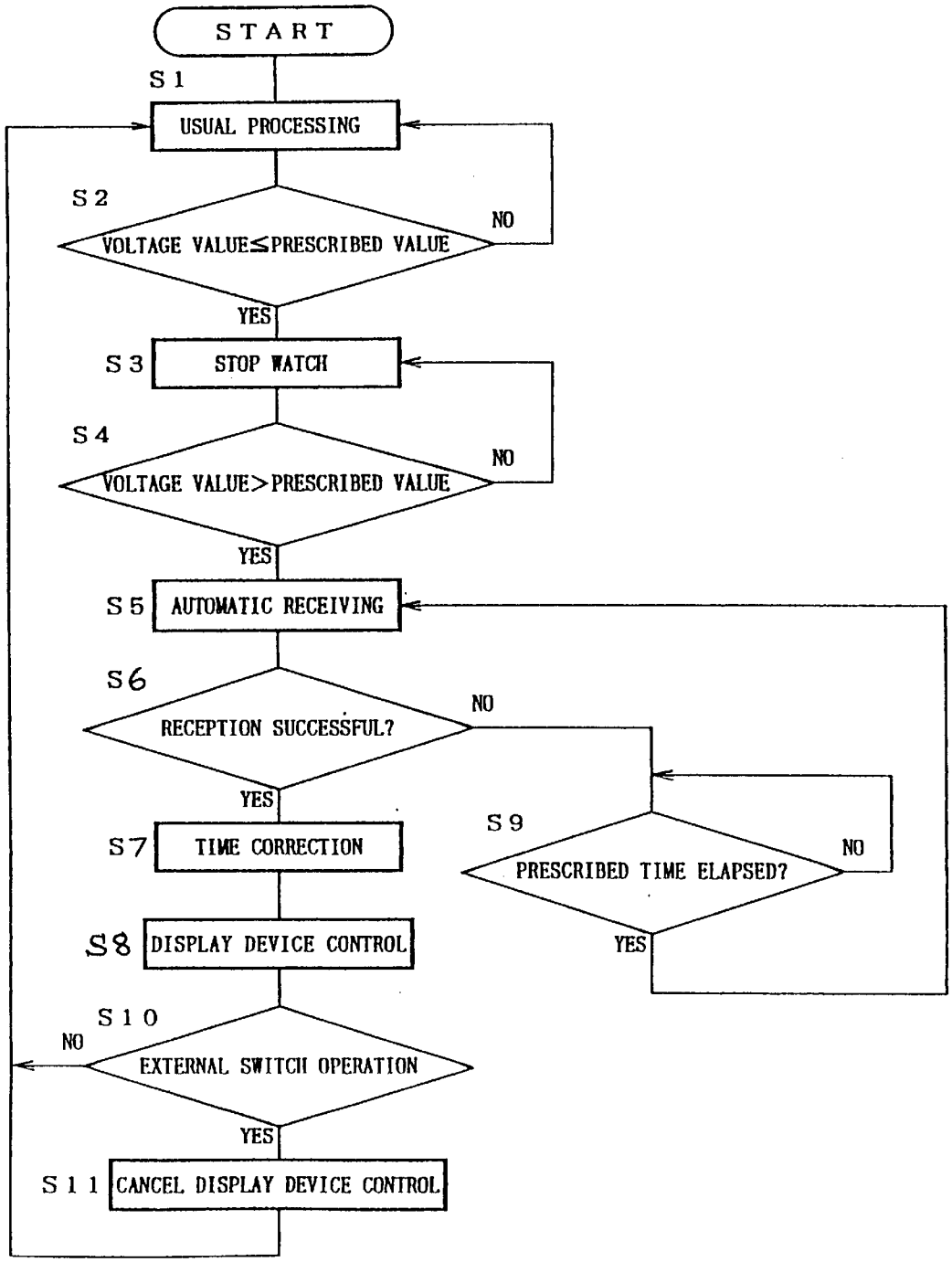
FIG. 8 is a flowchart which shows an example of the operation of the fourth embodiment of a radio-signal corrected watch according to the present invention.

In FIG. 8, at step 1 processing is performed as in a conventional watch.

Step 1 includes periodic receiving control by means of the time signal generating circuit 3.

At step 2, a judgment is made as to whether the voltage of the power supply as dropped to below a prescribed amount.

At this point, if the result is NO, return is made to step 1. If the result at step 2 is YES, the watch circuit 300 is stopped (step 3).

Then, at step 4, the voltage of the power supply 8 is detected and a judgment is made as to whether or not it exceeds a prescribed value. If the judgment result is NO, return is made to step 3, and if the judgment result is YES, the automatic receiving enabling means 23 causes the receiving circuit 42 to operate (step 5).

When reception is completed, a judgment as to whether or not reception was successful is made at step 6. If the result of this judgment is YES, timekeeping correction is performed (step 7), and at step 8 there is a display made on the display device that the reception succeeded. If the user operates an external switch at this point (step 10), this display is cleared (step 11) and return is made to step 1.

At step 10, if there is no operation of an external switch, this display is continued.

If the result of the judgment at step 6 was NO, a judgment is made at step 9 as to wither a prescribed amount of time has elapsed.

The prescribed time to be set is set to be smaller than the periodic receiving control interval which is output from the time signal generating circuit 3 (for example 1 hour). At this step 9, if the prescribed amount of time has elapsed, automatic receiving is performed once again. This is automatic receiving is performed until the reception succeeds and the time is corrected.

In the fourth embodiment as described above, in the case in which automatic receiving is not possible, because receiving is performed with an interval that is shorter than the usual periodic receiving interval, it is possible to perform time correction quickly. Also, because the fact that the time has been corrected by means of automatic receiving is displayed on the display device, it is possible for the user to know that the clock had been temporarily stopped.

Fifth Embodiment

Figure 9:
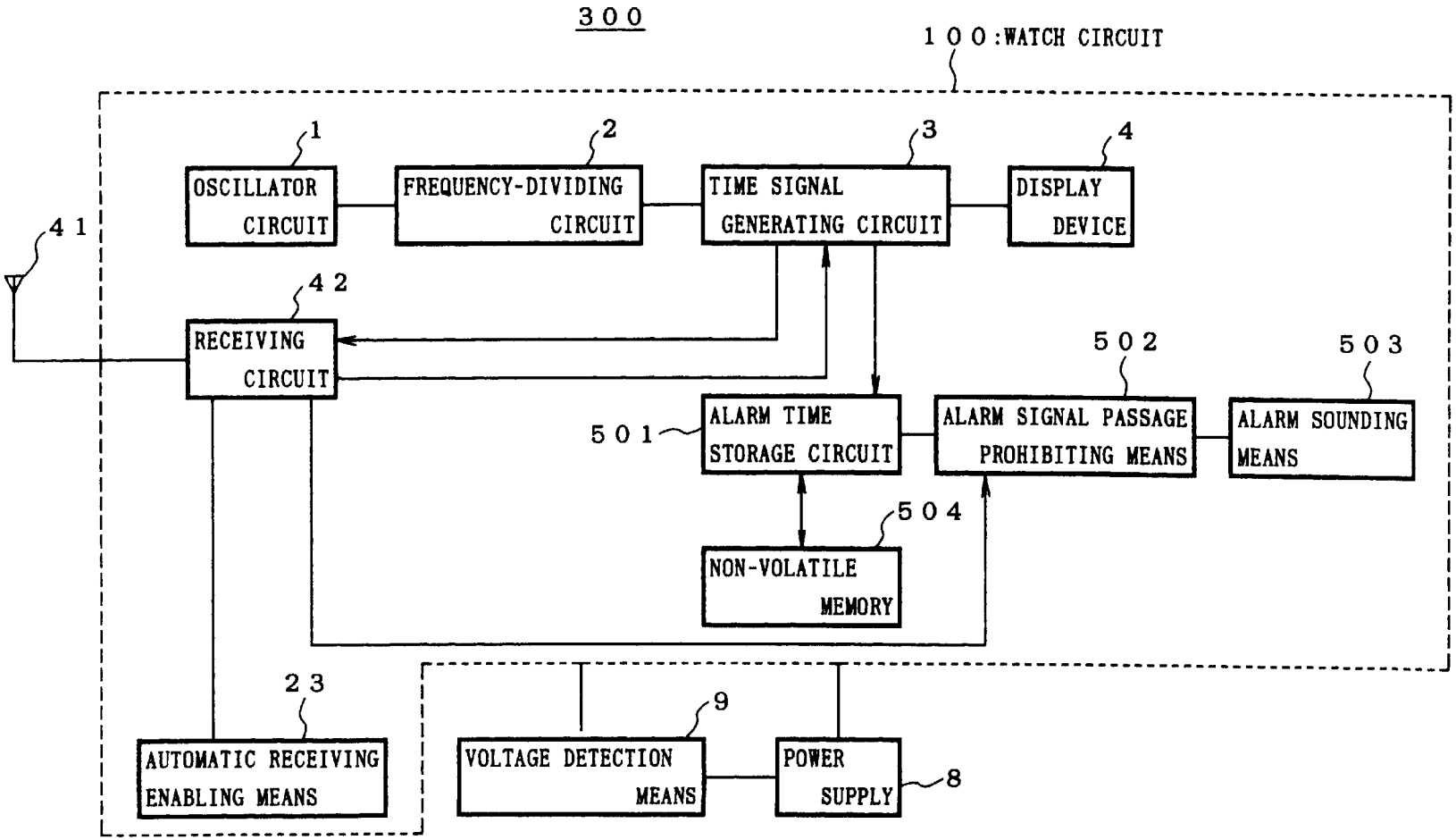
FIG. 9 is a block diagram which shows the configuration of the fifth embodiment of a radio-signal corrected watch according to the present invention.

FIG. 9 shows the fifth embodiment of a radio-signal corrected watch 300 according to the present invention, this drawing showing the example of the case in which an alarm function is added to the radio-signal corrected watch as an additional function.

In this drawing, elements corresponding to elements in FIG. 1 have been assigned the same reference numerals, and will omitted from this description.

In this embodiment, the receiving circuit 42 is configured so as to output a reception succeeded signal if the reception succeeds.

The alarm time storage circuit 501 stores an alarm and outputs an alarm signal if the time of the time signal generating circuit 3 coincides with the stored alarm time.

The alarm signal passage prohibiting means 502 holds the history of the circuit when the circuit is reset, and prohibits the passage of the alarm time.

If either the reception succeeded signal is output from the receiving circuit 42 or the time is corrected by means of the switch means ((not shown in the drawing), the held reset history is canceled.

The time alarm sounding means 503 sounds an alarm when it receives the alarm signal via the alarm signal passage prohibiting means 502. The non-volatile memory 504 stores the time of the alarm time storage circuit 501 when a stop signal is output by the voltage detection signal 9.

The specific operation of this embodiment is as follows.

When the voltage of the power supply 8 is in the normal condition, the time signal that is generated by the time signal generating circuit 3 is displayed on the display device 4, this operating as the usual watch. When the time set by the user is reached, the alarm time storage circuit outputs an alarm signal.

Because the condition is normal, the alarm signal passage prohibiting means 502 causes the alarm signal to be passed, which results in the alarm sound being generated by the alarm sounding means 503.

At this point, if the voltage of the power supply 8 drops below a prescribed value, the voltage detection means 9 outputs a stop signal. Upon receiving this signal, the non-volatile memory 504 stores the data of the alarm time storage circuit means 501.

Then, the watch circuit 300 is reset so as to stop.

Thereafter, if the voltage of the power supply 8 rises so that it exceeds the prescribed value, the non-volatile memory 504 outputs the stored time to the alarm time storage circuit 501. This causes a return of the alarm time storage circuit 501 to the condition it was in before stopping. At this point, because the alarm signal generating circuit 3 is stopped, an erroneous time signal is generated after the voltage of the power supply 8 is restored.

Because of this, if there is an incidental coincidence between the alarm time storage circuit 501 time and this erroneous time signal, the alarm time storage circuit 501 will output an alarm signal.

However, because there is a reset history of the alarm signal passage prohibiting circuit 502, the passage of this alarm signal is prohibited. Therefore, the alarm sounding means 503 does not sound an alarm.

When the voltage of the power supply 8 is restored and the stop signal is canceled, the automatic receiving enabling means 23 outputs the receiving command signal to the receiving circuit 42.

The receiving circuit 42 begins to operate, and when the reception succeeds, the correct time is output to the time signal generating circuit 3. Simultaneously with this, because a reception succeeded signal is output to the alarm signal passage prohibiting circuit 402, the alarm signal passage prohibiting means 502 is returned to the normal condition.

Thus, thereafter if the alarm time coincides with the time signal, the alarm sounding means 503 sounds an alarm.

In this embodiment as described above, in the case in which the time has stopped so that it is disturbed, even if the alarm signal and the time signal coincide, because the alarm sounding means 503 is not driven, it is possible to prevent confusion and misunderstanding on the part of the user.

While in this embodiment a volatile memory was used as the alarm time storage circuit 501, it is also possible to make this embodiment of the present invention using a configuration which has a non-volatile memory, in which case the non-volatile memory 504 can be eliminated.

Sixth Embodiment

Figure 10:
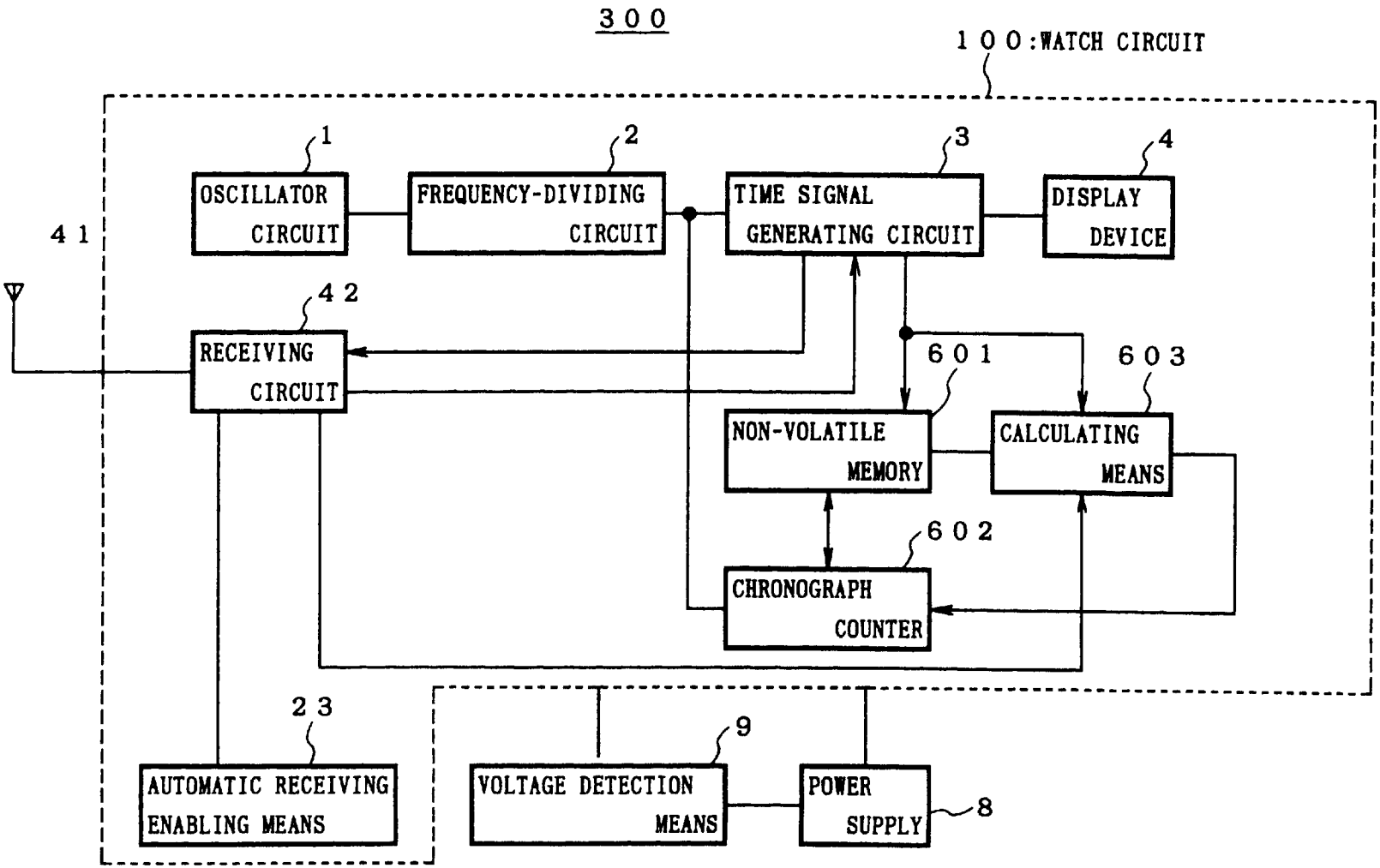
FIG. 10 is a block diagram which shows the configuration of the sixth embodiment of a radio-signal corrected watch according to the present invention.

FIG. 10 shows the sixth embodiment of the present invention, in which elements corresponding to elements in FIG. 1 have been assigned the same reference numerals, and will omitted from this description.

In the drawing, the reference numeral 601 denotes a non-volatile memory which stores the current time information of the time signal generating circuit 3 and the time information of a chronograph counter 602, and when the voltage detection means 9 detects a drop to below a prescribed value so that the watch circuit 100 stops, it also stores that stopping time.

The chronograph counter 602 performs watch operation in accordance with control by operation of an external switch (not shown in the drawing). When the reception succeeded signal is input from the receiving means, the calculating means 603 performs a comparison calculation between the current time data that is input to the time signal generating circuit 3 and the clock stopping time that is stored in the non-volatile memory 601, and outputs the difference therebetween to the chronograph counter 602.

Figure 11:
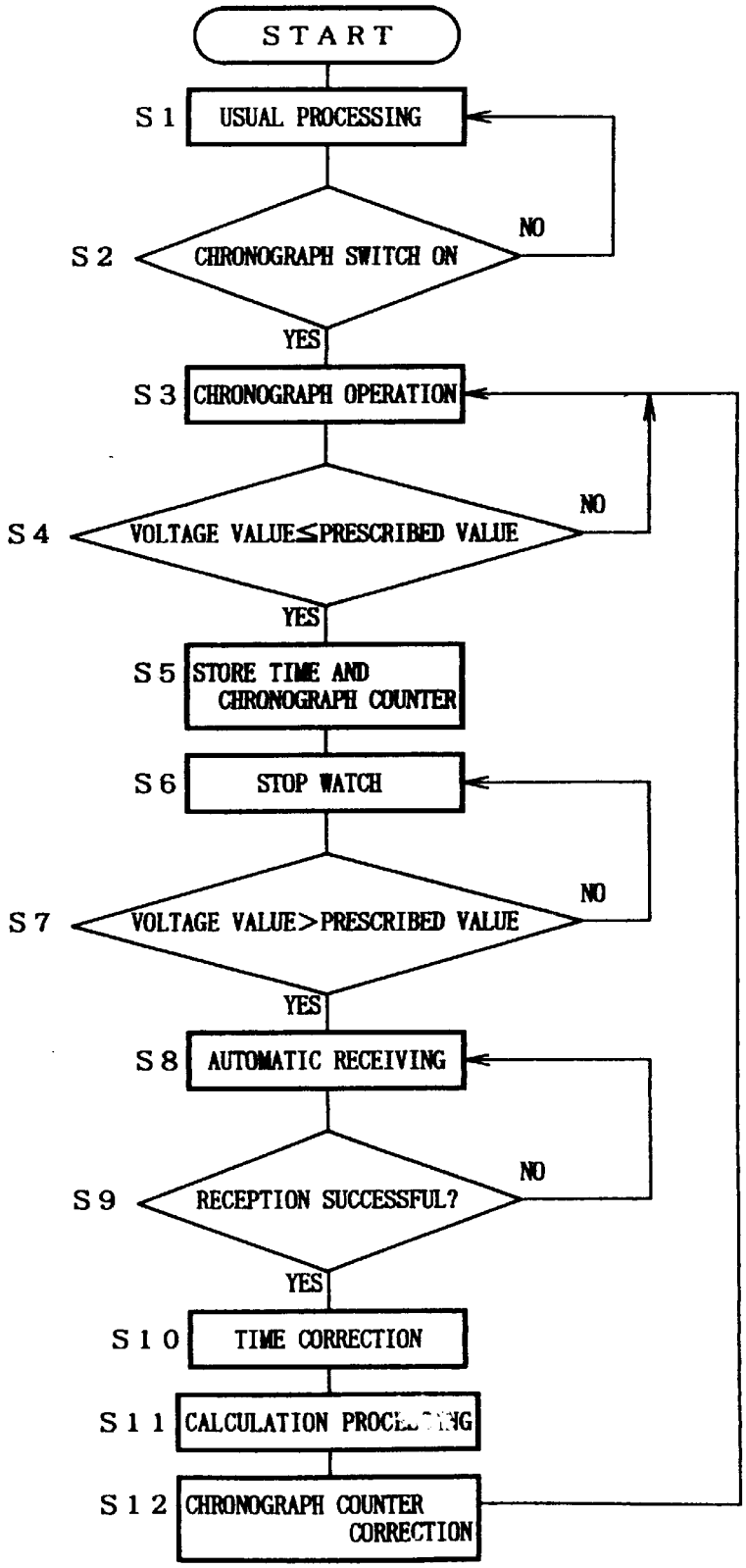
FIG. 11 is a flowchart which shows an example of the operation of the sixth embodiment of a radio-signal corrected watch according to the present invention.

The specific operation of this sixth embodiment will now be described, with reference being made to the flowchart which is shown in FIG. 11.

At step 1, normal processing is performed. At this point if the chronograph switch is set to on (Y at step 2), the chronograph starts timekeeping operation (step 3). (In the case of N at step 2, return is made to step 1.)

At this point if the voltage value of the power supply 8 falls below a prescribed value (Y at step 8), the detection signal of the voltage detection means 9 causes the non-volatile memory 601 to store the current time data of the time signal generating circuit 3 (step 6), and the watch circuit 300 is immediately stopped (step 6).

(In the case of N at step 4, return is made to step 3). At this point, if the voltage of the power supply 8 exceeds the prescribed value (Y at step 7), the automatic receiving circuit 7 places the receiving circuit 42 in the operating condition, and reception of the radio signal begins (step 8). (In the case of N at step 7, return is made to step 6.)

At step 9 a judgment as to the success of the reception is made and, if the results is N, return is made once again to step 8, whereupon automatic receiving is performed.

At this time, it is possible to perform receiving after the elapse of a prescribed time interval, as was explained in the case of the fifth embodiment.

In the case of Y at step 9, the time data of the time signal generating circuit is corrected (step 10), the calculating means 603 performs a comparison calculation between the corrected time data and the data in the non-volatile memory 601 (step 11), the difference being output to the chronograph counter 602.

The chronograph counter 602 adds the above calculation results to the time data stored in the non-volatile memory 602 (step 12), and again goes into the chronograph operating mode.

As described above, in the sixth embodiment of a radio-signal corrected watch according to the present invention, because the time at which the watch is temporarily stopped is stored, when the watch function is restored, it is possible to read out the stopping time, enabling correction of the chronograph counter, so that even after restoring a temporarily stopped watch, there is no disturbance to the chronograph time.

With regard to this sixth embodiment in particular, a radio-signal corrected watch can also be configured so as to have a first storage means which stores the time at which the reception of the radio signal having a time code was stopped in response to a stop signal in accordance with the receiving enabling means 12 when the receiving enabled discriminating means 9 detects the existence of the condition in which it is not possible for the time code receiving means 13 to receive a radio signal having a time code, a calculation means which, when the receiving enabled condition discriminating means 9 detects the condition in which it is possible for the time code receiving means 13 to receive a radio signal having a time code, calculates from the information of the storage means and the time received as a result of the time code receiving means, the amount of difference between the drive stopping time of the watch circuit in accordance with the receiving stop signal of the receiving enabling means 12 and the drive time of the receiving enabling means, and an overwriting means which, based on the output information from the above-noted calculation means, overwrites prescribed information which had already been stored in a processing means that executes various individual functions.

In a radio-signal corrected watch 300 according to the present invention, it is possible to provide an automatic receiving enabling means 22 which, in the period during which the above-noted receiving enabled condition discriminating means 9 detects the condition in which reception is possible of a radio signal having a time code, regardless of the display contents selected by the above-noted display contents selecting means 7, sets the time code receiving means 13 to the receiving condition. Furthermore, it is possible that after the time code receiving means 13 detects that the reception of the radio signal having a time code was successful, the display contents selecting means 13 be configured so as to display the display contents that were displayed immediately before the start of the reception of the radio signal having the time code.

Additionally, a radio-signal corrected watch according to the present invention can have a means which, in the case in which the receiving enabled condition discrimination means 9 detects the condition in which it is not possible to receive a radio signal having a time code, resulting in it being impossible for the time code receiving means 13 to receive the radio signal having a time code, does not cause the alarm function of a multifunction radio-signal corrected watch to operate.

Additionally, as described above, in the case in which the receiving enabled condition discriminating means 9 detects the condition in which it is not possible to receive a radio signal having a time code, resulting in it being impossible for the time code receiving means 13 to receive the radio signal having a time code, it is desirable to shorten the subsequent operating interval of the receiving enabled condition discriminating means 9 and to repeatedly perform this operation until the reception of the radio signal having a time code succeeds. In a radio-signal corrected watch 300 according to the present invention, it is also desirable to provide a notifying means, so that when the receiving enabling means outputs a receiving stop signal so that the operation of the time code receiving means 13 is temporarily stopped, thereafter when the receiving enabled condition discriminating means 9 detects that the time code receiving means 13 is in the condition in which it can receive, after causing the drive of the time code receiving means 13 to begin, the above-noted notifying means makes notification that the time information displayed on the display device 4 is different from the time information which is being kept by the watch means.

In the present invention, it is additionally desirable that a correction alarm condition setting means be provided so that, even if the automatic receiving condition setting means 22 is in the automatic receiving condition and the time code receiving means 13 transitions to the receiving condition, if the reception of the time code is not possible, the above-noted correction alarm condition setting means maintains the correction alarm condition until correction is made by mean of the watch means 3.

It is more desirable that, in a radio-signal corrected watch 300 according to the present invention, control is performed so that, in the case in which a power supply voltage drop is detected during automatic receiving, the receiving operation is forcibly terminated.

It is desirable that the voltage at which the stop signal is canceled be set to a value that is higher than the voltage at which the stop signal is output by the voltage detection means 9.

As described above, in a radio-signal corrected watch 300 according to the present invention, because the automatic receiving condition is not limited to the home time display condition in which normal reception is possible, after recovery from the watch stopping voltage to the watch operating voltage, it is not necessary for the user to perform a setting of the hands.

What is claimed is:

1. A radio-signal corrected watch comprising:

a power supply means;

an oscillation means;

a frequency dividing means which frequency-divides an oscillation signal from said oscillation means;

a time signal generating means which generates a time signal based on a frequency-divided signal;

a display means which displays the timekeeping contents from the time signal generating means;

and a time code receiving means which receives a radio signal that has a time code therein and which sends time data to said time signal generating means, said watch further comprising:

a receiving enabled condition discriminating means which discriminates between a condition in which said time code receiving means is in a condition in which reception of said radio signal having a time code is possible and a condition in which the reception is not possible; and an automatic receiving means which, after said receiving enabled condition discriminating means detects said condition in which said time code receiving means is in the condition in that the reception of a radio signal having a time code is not possible, and when said receiving enabled condition discriminating means subsequently detects said condition in which said time code receiving means is in the condition in that the reception of said radio signal having a time code is possible, causes the start of the reception of said radio signal having a time code.

2. A radio-signal corrected watch according to claim 1, wherein said receiving enabled condition discriminating means makes a judgment based on one characteristic value selected from characteristics such as power supply voltage and generated amount.

3. A radio-signal corrected watch according to either claim 1 or claim 2, wherein said radio-signal corrected watch is a multifunction watch comprising at least a display contents selecting means, switching means and an alarm function or a chronograph function.

4. A radio-signal corrected watch according to claim 3, wherein an automatic receiving enabling means is provided and wherein, in the time period during which said receiving enabled condition discrimination means is detecting a condition in which reception of a radio signal having a time code is possible, regardless of what display contents are selected by said display content selecting means, said automatic receiving enabling means sets said time code receiving means to a receiving condition.

5. A radio-signal corrected watch according to claim 3, wherein after said time code receiving means succeeds in receiving said radio signal having a time code, said display contents selecting means is configured to display the contents that were displayed immediately before the start of the reception of said radio signal having a time code.

6. A radio-signal corrected watch according to either claim 1 or 2, having a means which, when said receiving enabled condition discriminating means detects the condition in which reception of said radio signal having a time code is not possible, resulting in it being not possible for the time code receiving means to receive said radio signal having a time code, does not allow an alarm function of a multifunction radio-signal corrected watch to operate.

7. A radio-signal corrected watch according to either claim 1 or 2, wherein in the case in which said receiving enabled condition discriminating means detects a condition in which reception of said radio signal having a time code is not possible, resulting in it being not possible for the time code receiving means to receive said radio signal having a time code, the subsequent operating interval of the judgment operation of said receiving enabled condition discrimination means is set so as to be short, and said operation is repeated until the reception of said radio signal having a time code is completed.

8. A radio-signal corrected watch according to claim 4, wherein said watch comprises:

a storage means which, when said receiving enabled condition discriminating means detects a condition in which reception of said radio signal having a time code is not possible, so that in response to a receiving stop signal from said receiving enabling means the reception of said radio signal having a time code is stopped, stores the time of stopping of reception;

a calculation means which when said receiving enabled condition discriminating means detects the condition in which it is possible for said time code receiving means to receive said radio signal having a time code, resulting in said receiving enabling means calculates from information of the time when it receives said radio signal having a time code and of said storage means, the amount of difference between the drive stopping time of said watch circuit in accordance with said receiving stop signal of said receiving enabling means and the drive time of the receiving enabling means; and an overwriting means which, based on the output information from said calculation means, overwrites prescribed information which had already been stored in a processing means which executes various individual functions.

9. A radio-signal corrected watch according to claim 4, which is provided with a notifying means which, when, based on a receiving stop signal that is output by said receiving enabling means the operation of said time code receiving means temporarily stops, after which said receiving enabled condition discriminating means detects that said time code receiving means is in a condition in which it can receive, after causing drive of said time code receiving means to begin, when a time correction is made, makes notification on said display device that a time correction has been made.

10. A radio-signal corrected watch according to either claim 1 or 2, which is provided with a correction alarm condition setting means which, even if said time code receiving means transitions to a receiving condition and time code reception is not possible, maintains a correction alarm condition until a correction is made of said watch means.

11. A radio-signal corrected watch according to either claim 1 or 2, wherein said power supply comprises an electrical generating means and an electrical storage means.

12. A radio-signal corrected watch according to claim 11, wherein said electrical storage means has characteristics which exhibit both increase and decrease in output voltage.

13. A radio-signal corrected watch according to claim 11, wherein said electrical generating means is either a mechanical generating means or a solar cell.

* * * * *